US006986275B2

(12) United States Patent
Conner

(10) Patent No.: US 6,986,275 B2
(45) Date of Patent: Jan. 17, 2006

(54) AUTOMOTIVE CLAMP ACCESSORY

(76) Inventor: Steven G. Conner, 9541 John Tapp Rd., Corydon, Henderson County, KY (US) 42406

( * ) Notice: Subject to any disclaimer, the term of this patent is extended or adjusted under 35 U.S.C. 154(b) by 51 days.

(21) Appl. No.: 10/807,864

(22) Filed: Mar. 23, 2004

(65) Prior Publication Data

US 2005/0138987 A1 Jun. 30, 2005

Related U.S. Application Data

(60) Provisional application No. 60/532,744, filed on Dec. 29, 2003.

(51) Int. Cl.
*B21J 13/08* (2006.01)

(52) U.S. Cl. ..... 72/457; 72/705

(58) Field of Classification Search ..... 72/301, 72/302, 308, 457, 705; 294/92, 106; 24/489; 248/674, 300; 280/504
See application file for complete search history.

(56) References Cited

U.S. PATENT DOCUMENTS 3,610,022 A * 10/1971 Lincourt ..... 72/457
4,037,456 A * 7/1977 Jarman ..... 72/325
4,106,325 A * 8/1978 Kuhn ..... 72/457
4,138,877 A * 2/1979 Specktor ..... 72/461
4,296,626 A * 10/1981 Jarman et al. ..... 72/392
4,324,125 A * 4/1982 Jarman et al. ..... 72/479
4,457,159 A * 7/1984 Jarman et al. ..... 72/422
4,815,719 A * 3/1989 Peters et al. ..... 269/130
5,156,037 A * 10/1992 Bundy ..... 72/422

* cited by examiner

*Primary Examiner*—Ed Tolan
(74) *Attorney, Agent, or Firm*—Gary K. Price, Esq.

(57) ABSTRACT

An automotive clamp accessory that can be used with existing prior art clamps to pull on a damaged vehicle's frame. The clamp accessory can be attached to a variety of types of damaged vehicle frames and locations without first being required to remove bolted-on vehicle parts or attached glass in order for the pull clamp to properly access or grab the frame. Once the clamp accessory is attached, straightening is accomplished by pulling on the clamp accessory with an external force to return the frame back to its original shape. In the preferred embodiment, the clamp accessory includes a first end portion, a second end portion, and a wall disposed between the first and second ends that forms a "stair-step" configuration. The first end portion having a pair of opposing pivot bores for mounting the prior art pull clamp thereto. The pivot bores allow the pulling clamp to be tightened in selected positions for various straightening applications. In position, the clamp accessory passes over the damaged frame so that the body bore of the clamp accessory is aligned and on an axis with the clamp jaws of the pull clamp.

19 Claims, 4 Drawing Sheets

AUTOMOTIVE CLAMP ACCESSORY

CROSS REFERENCES TO RELATED APPLICATIONS

U.S. Provisional Application for patent Ser. No. 60/532,744, filed Dec. 29, 2003, with title "Adjustable Automotive Clamp Accessory that Allows a Forward or Angled Pull on a Post or Panel that has a Lip on the Rear of the Post or Panel" which is hereby incorporated by reference. Applicant claims priority pursuant to 35 U.S.C. Par. 119(e)(i).

Statement as to rights to inventions made under Federally sponsored research and development: Not Applicable

BACKGROUND OF THE INVENTION

1. Field of the Invention

The present invention relates generally to vehicle collision repair, in particular to the straightening of a damaged post or panel of the vehicle's body or frame. Specifically, the present invention is directed to a clamp accessory that can be used with existing prior art clamps to pull on a damaged vehicle's post or panel that has an edge, or lip disposed on the rear of the post or panel. Once the prior art clamp, and clamp accessory of the present invention is attached, straightening is accomplished by pulling on the clamp accessory with an external force to return the post or panel back to its original shape.

2. Brief Description of Prior Art

Automotive accidents produce damage of varying severity to the involved vehicles. In a relatively minor automobile accident of the "fenderbender" type, only the bodywork of the automobile is damaged. The automobile can then be generally repaired by replacing the damaged bodywork panel. In more severe accidents, all or part of the frame of the automobile can be bent, in addition to the bodywork panels.

The prior art method to repair a damaged vehicle's bent frame is to generally grab hold of the damaged portion with a prior art pull clamp or sling, attach an external frame straightening puller to the frame, and apply a sufficiently large pulling force by the external puller to the pull clamp or sling and thence to the frame, so that the frame is straightened back to its original form.

A problem with the prior art method discussed above is that it is often required to remove bolted-on vehicle parts such as headlights, fenders, etc., or attached glass such as windshields, windows etc., in order for the pull clamp or sling to properly access or grab the frame. Removing vehicle parts in order to ultimately access the damaged frame of the vehicle results in increased labor cost, as well as additional risk of windshield or window breakage and bodywork damage.

The present invention concerns an automotive clamp accessory that allows a prior art pull clamp to grip the rear edge or lip of a damaged post or panel without first being required to remove bolted-on vehicle parts or attached glass in order for the pull clamp to properly access or grab the frame. As will be seen from the subsequent description, the preferred embodiments of the present invention overcome the above problems and difficulties of the prior art.

SUMMARY OF THE INVENTION

The present invention is directed to an automotive clamp accessory that can be used with existing prior art clamps to pull on the rear edge or lip of the post of panel of a damaged vehicle's frame. Once a prior art pull clamp, and automotive clamp accessory of the present invention is attached, straightening is accomplished by pulling on the automotive clamp accessory with an external force to return the post or panel back to its original shape. The automotive clamp accessory allows a prior art pull clamp to grip the rear edge or lip of a damaged post or panel without first being required to remove bolted-on vehicle parts or attached glass in order for the pull clamp to properly access or grab the frame. The automotive clamp accessory includes a base member formed of a first end portion, a second end portion, and a wall disposed between the first and second ends. The second end portion includes a body bore for attaching the clamp accessory to a chain and external force applying device. The first end portion having a pair of opposing pivot bores for mounting the prior art pull clamp thereto. The clamp accessory further includes side walls that extend the length of the base member.

In application, prior art pulling clamp is positioned to grip onto the damaged portion of the vehicle frame. The clamp accessory is slid over the sliding bars of the pull clamp and tightened with nuts. The pulling clamp may be tightened in selected positions for various straightening applications. In position, the clamp accessory passes over the damaged frame so that the body bore of the clamp accessory is aligned and on an axis with the clamp jaws of the pull clamp. A pulling chain is attached to the body bore to exert the forward pulling force on the axis.

DESCRIPTION OF THE PREFERRED EMBODIMENT

Figure 1:
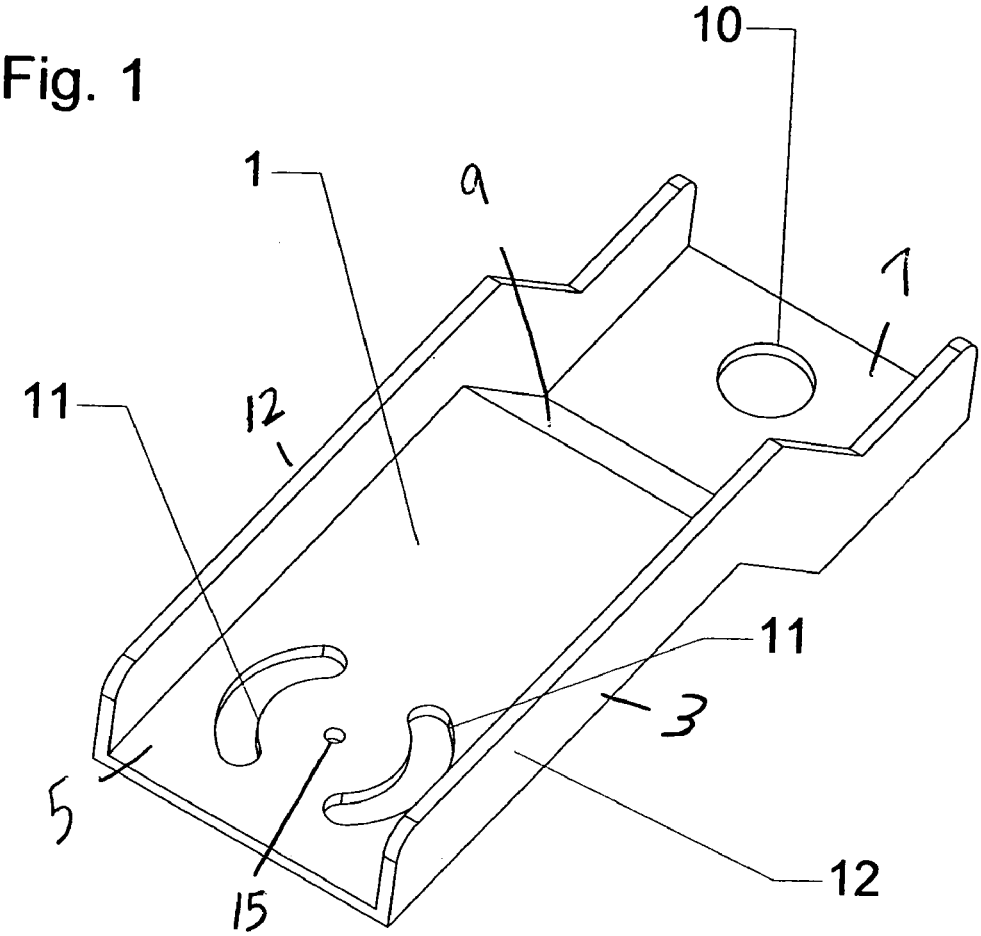
FIG. 1 is a top perspective view of a preferred embodiment of the present invention, an automotive clamp accessory.

In accordance with the present invention, an automobile clamp accessory used when straightening a damaged vehicle's body or frame is disclosed. The automotive clamp accessory is directed to an automotive clamp accessory that can be used with existing prior art clamps to pull on the rear edge or lip of the post of panel of a damaged vehicle's frame. Once the prior art clamp is attached to the damaged portion of the vehicle frame and to the clamp accessory of the present invention, straightening is accomplished by pulling on the automotive clamp accessory with an external force to return the post or panel back to its original shape.

Specifically, it will be noted in the drawings that the automotive clamp accessory relates to an apparatus that allows a prior art pull clamp to grip the rear edge or lip of a damaged post or panel without first being required to remove bolted-on vehicle parts or attached glass in order for the pull clamp to properly access or grab the frame. In the broadest context, the automotive clamp accessory of the present invention consists of components configured and correlated with respect to each other so as to attain the desired objective.

Figure 2:
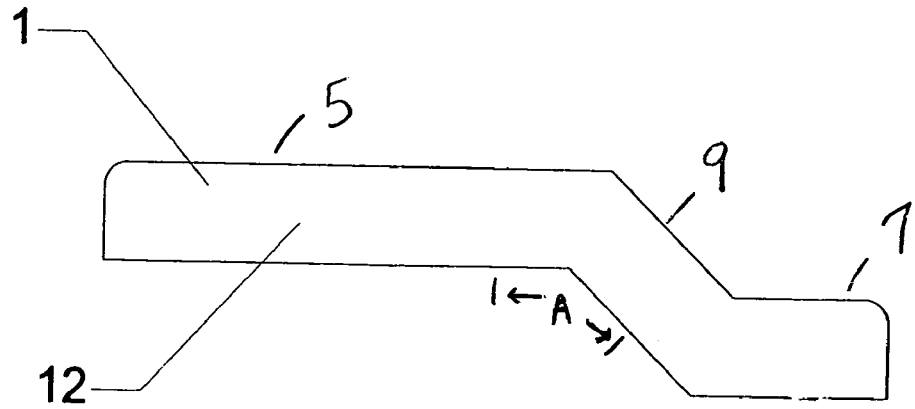
FIG. 2 is a side view of the automotive clamp accessory of FIG. 1.
Figure 3:
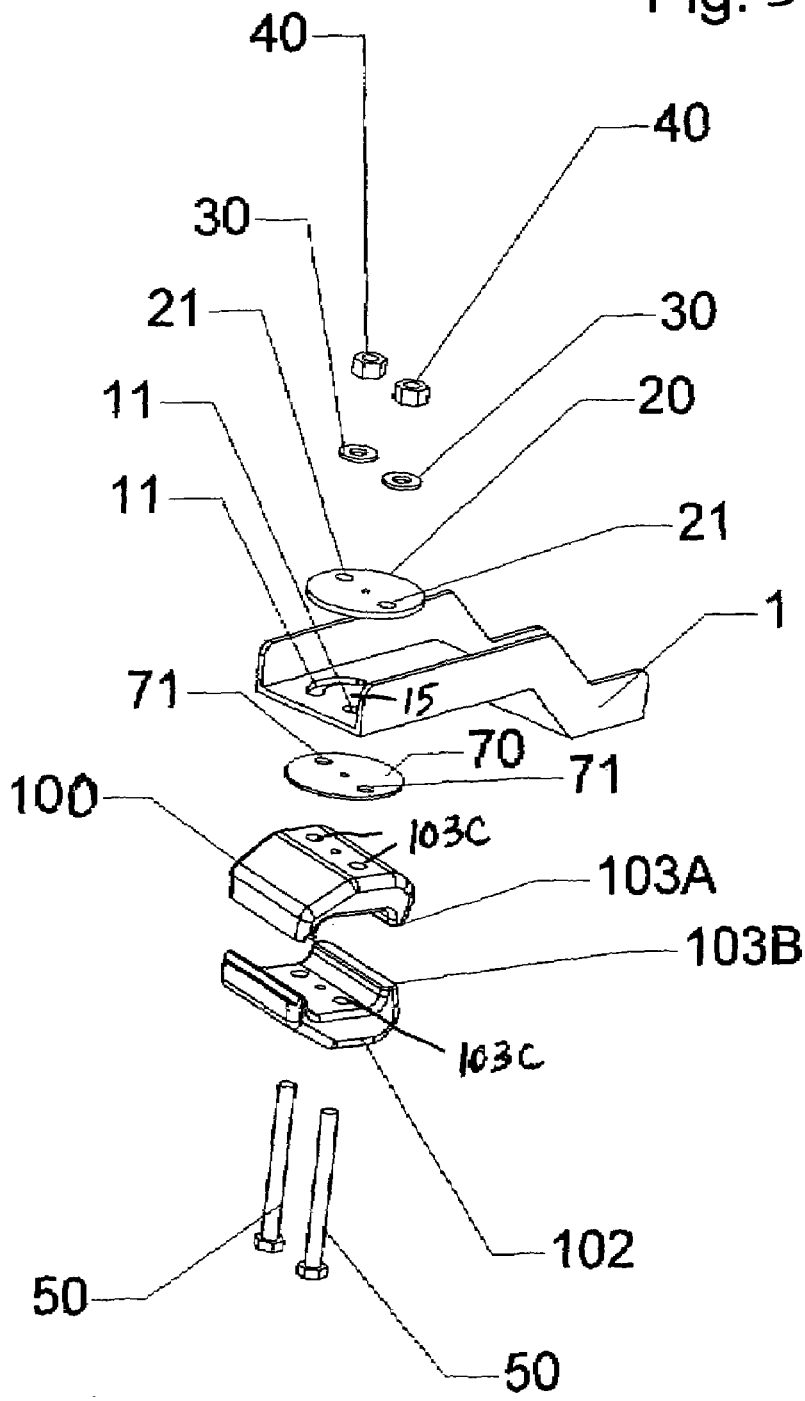
FIG. 3 is an exploded view of the automotive clamp accessory of FIG. 1 and further illustrates a prior art pull clamp.
Figure 4:
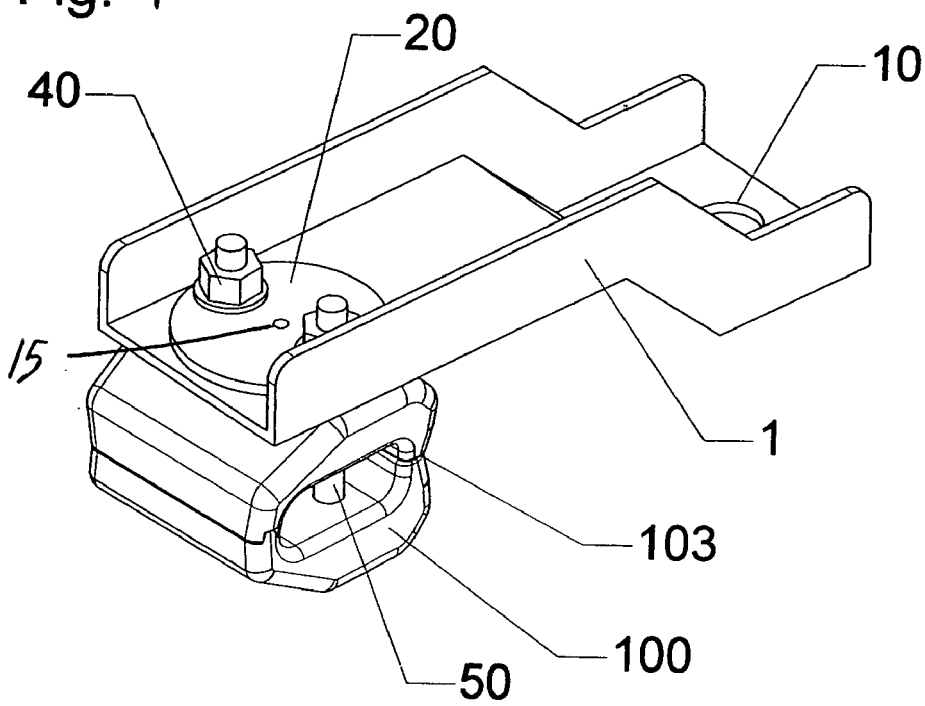
FIGS. 4 and 5 is a side perspective view of the automotive clamp accessory of FIG. 1 mounted to the prior art pull clamp.
Figure 5:
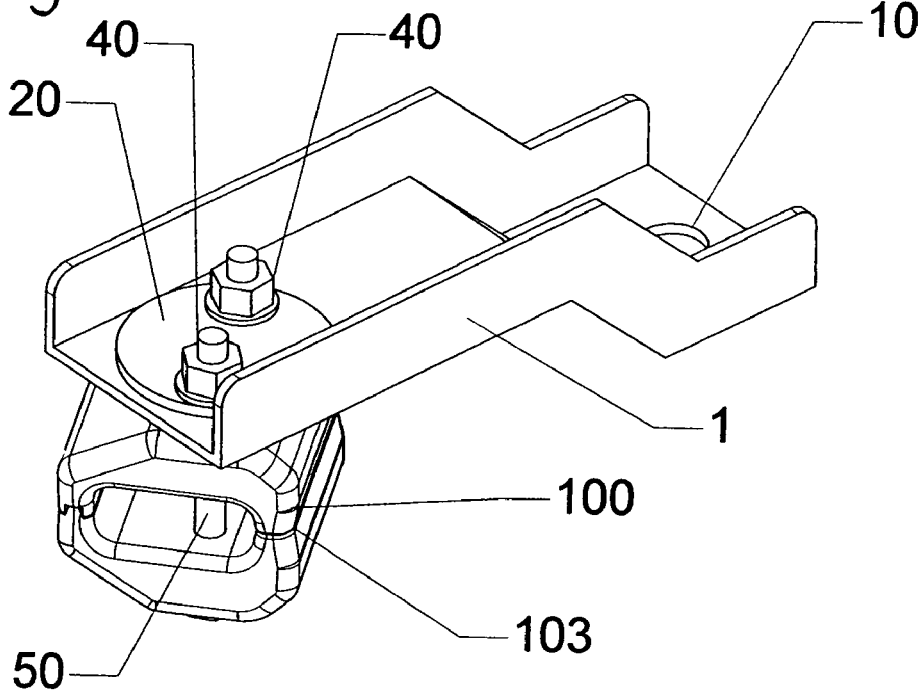
Figure 6:
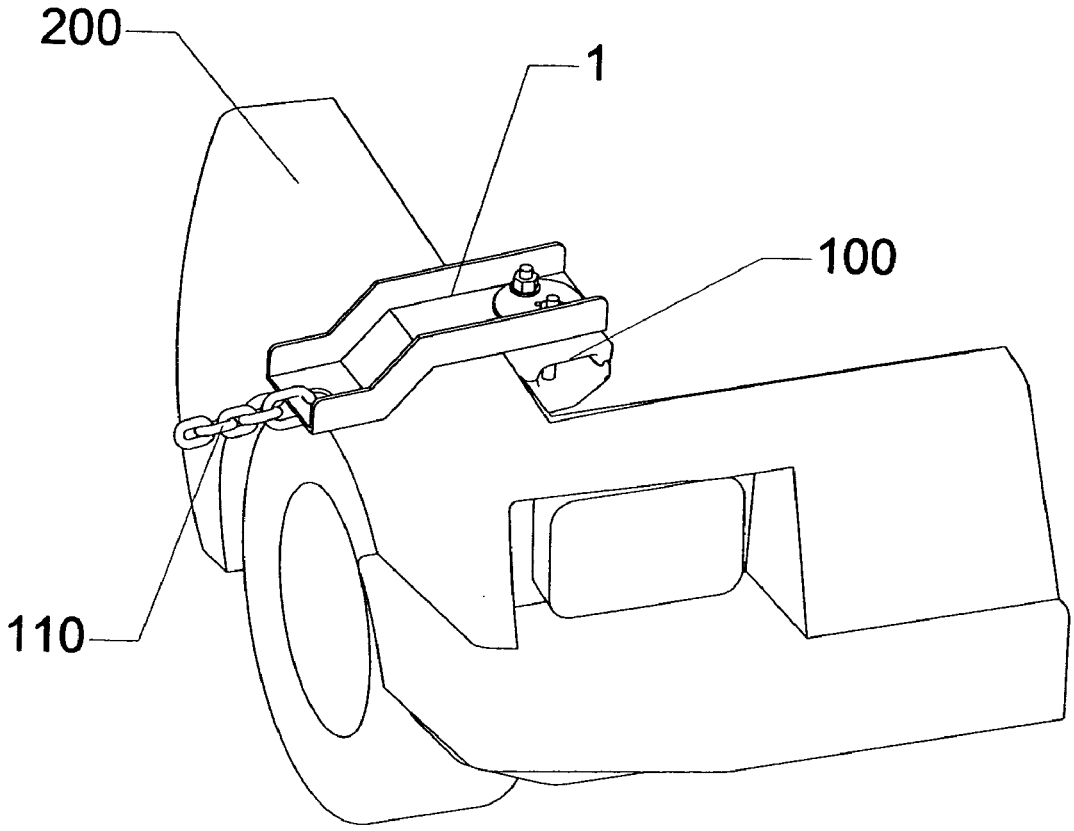
FIG. 6 is a perspective view of the attachment of the automotive clamp accessory mounted to the prior art pull clamp as shown in FIGS. 4 and 5 to an automobile fender.

FIGS. 1–6 illustrate a preferred embodiment of an automotive clamp accessory 1 made in accordance of the present invention. FIGS. 1 and 2 depict top perspective and side views of the clamp accessory 1. FIG. 3 shows an exploded view of a prior art pull clamp 100 and the clamp accessory 1. FIGS. 4 and 5 depict top perspective views of the clamp 100 mounted to the clamp accessory 1, differing only to the extent that FIG. 4 illustrates the clamp 100 rotated in relation to the clamp accessory 1 in a first position, and FIG. 5 illustrates the clamp 100 rotated in relation to the clamp accessory 1 in a second position. FIG. 6 illustrates the clamp accessory 1 mode of attachment to an automobile frame 200.

Referring to FIG. 1, the automotive clamp accessory 1 may be described as having a base member 3 formed of a first end portion 5 and a second end portion 7. As will be further described, the first end portion 5 representing the rotatable clamping portion for mounting to the prior art pull clamp 100. The base member 3 of the clamp accessory 1 further includes a slanted wall 9 integral to, and disposed between the first and second ends 5, 7, so that the first end portion 5 is elevated in relation to the second end portion 7, thence forming a "stair-step" configuration, as best shown in FIG. 2. In the preferred embodiment, the slanted wall 9 constructed having an angle designated as letter "A" in FIG. 2, preferably a 45 degree angle.

The second end portion 7 of the base member 3 including a body bore 10 for attaching the clamp accessory 1 to a chain 110 (shown in FIG. 6) and external force applying device (not shown). The first end portion 5 including a pair of opposing pivot bores 11 for mounting the prior art pull clamp 100 to the first end 5 of the clamp accessory 1, as best shown in FIGS. 3–5. As shown in FIG. 1, the pivot bores 11 each having generally a "kidney shaped" configuration. This configuration is important for proper rotation of the pull clamp 100 when mounted to the clamp accessory 1 as shown in FIGS. 4 and 5.

The clamp accessory 1 further includes side walls 12 that extend the length of the base member 3. The base member 3 and side walls 12 can be manufactured as separate pieces and then assembled together in the form shown in the drawings or in the alternative, can be manufactured as a single piece.

FIG. 3 best illustrates the components of the prior art pull clamp 100. The clamp 100 generally includes upper and lower jaws 103A and 103B, and sliding bars 50 having threaded ends that slide through apertures 103C in the jaws 103A and 103B. Washers 30 and nuts 40 assemble and tighten the pull clamp 100 in position in the form shown in FIGS. 4–6.

The clamp 100 is mounted to the first end portion 5 of the clamp accessory 1 as shown in FIG. 3. In particular, the sliding bars 50 slide through the apertures 103C of the jaws 103A, 103B as described above, and preferably through apertures 71 of a spacer plate 70, through the pivot bores 11 in the first end portion 5, and through apertures 21 of a reinforcement plate 20. The washers 30 and nuts 40 assemble and tighten the clamp accessory 1 to the pull clamp 100. As will be further described, the clamp 100 may be tightened in selected positions (see FIGS. 4 and 5 for example) for various straightening applications, by sliding the sliding bars 50 within the pivot bores 11 until the clamp 100 is properly positioned to grab hold of the damaged portion with the jaws 103A, 103B of the clamp 100.

As best shown in FIGS. 1, 3 and 4, the clamp accessory 1 further includes a center hole 15 disposed at an equal distance between the pivot bores 11. The clamp 100 may be selectively positioned at an approximate 45 degree angle, in either direction, with respect to the center hole 15.

In the preferred embodiment the clamp accessory 1 includes the spacer plate 70 disposed between the clamp 100 and the clamp accessory 1 as described above however, the spacer plate 70 is optional to the operation of the present invention. The reinforcement plate 20 positioned on the upper surface of the first end portion 5 of the clamp accessory 1 provides reinforcement or added strength to the base 3 of the clamp accessory 1 during application.

The present invention allows a forward pull on the vehicle's damaged frame without first removing obstructing vehicle parts. To use the clamp accessory 1 in frame straightening, the jaws 103A, 103B of the prior art clamp 100 is positioned to grip onto the rear edge of the vehicle frame's post or panel. The clamp accessory 1 is then slid over the sliding bars 50 of the pull clamp 100 and tightened with nuts 40, thereby fixing the pull clamp 100 to the frame and to the clamp accessory 1. In application, the clamp accessory 1 passes over the damaged post or panel, and the stair-step configuration of the clamp accessory 1 as described fits over the damaged portion of the frame at an inward direction. As shown in FIGS. 4–6, in position, the body bore 10 is aligned and on an axis with the jaws 103A, 103B of the pull clamp 100. The pulling chain 110 is attached to the body bore 10 to exert the forward pulling force on the axis.

Although the description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It will be obvious to those skilled in the art that modifications may be made to the embodiments described above without departing from the scope of the invention. Thus the scope of the invention should be determined by the claims in the formal application and their legal equivalents, rather than by the examples given.

I claim:

1. An automotive clamp accessory that attaches to a prior art pull clamp, said pull clamp including a pair of sliding bars and pulling jaws, said automotive clamp accessory comprising:

a base member comprising a first end portion, a second end portion, and a wall disposed between the first and second ends, the first end portion including a pair of opposing bores, wherein said bores are for rotatably attaching the prior art pull clamp to the clamp accessory, and means for attaching the pull clamp to the clamp accessory, and wherein an attachment point attaching said clamp accessory to an external force is aligned and on an axis with the pulling jaws of the pull clamp.

2. The automotive clamp accessory as recited in claim 1, wherein the bores each having a kidney shaped configuration.

3. The automotive clamp accessory as recited in claim 1, wherein the attachment point is a body bore through the second end portion.

4. The automotive clamp accessory as recited in claim 1, further including side walls that extend the length of the base member.

5. The automotive clamp accessory as recited in claim 3, wherein the external force is applied by a chain axially aligned with said body bore and said pulling jaws.

6. The automotive clamp accessory as recited in claim 2, wherein the sliding bars of the pull clamp are slidingly received within the bores of the clamp accessory in order to position the pull clamp.

7. The automotive clamp accessory as recited in claim 6, further including a center hole disposed at an equal distance between the opposing bores, wherein said pull clamp can be selectively positioned at on approximate 45 degree angle with respect to the center hole.

8. The automotive clamp accessory as recited in claim 7, wherein the sliding bars include threaded ends.

9. The automotive clamp accessory as recited in claim 8, wherein the pull clamp is fixed in position to the automotive clamp accessory with said threaded sliding bars and nuts.

10. The automotive clamp accessory as recited in claim 1, further including a reinforcement plate positioned on an upper surface of the first end portion, said reinforcement plate including a pair of apertures in alignment with the opposing bores.

11. An automotive clamp accessory that attaches to a prior art pull clamp, said automotive clamp accessory comprising:

a base member comprising a first end portion including a plate, a second end portion, and a slanted wall disposed between the first and second ends, said slanted wall creating a stair step between said first end portion plate and said second portion, the first end portion including a pair of opposing bores, wherein said opposing bores for attaching a prior art pull clamp to the clamp accessory, a body bore through the second end portion, means for fixedly attaching the pull clamp to the clamp accessory, and wherein the body bore attaches said clamp accessory to an external force and is aligned and on an axis with pulling laws of the prior art pull clamp.

12. The automotive clamp accessory as recited in claim 11, wherein the slanted wall is disposed at an approximate 45 degree angle in relation to the first end portion.

13. The automotive clamp accessory as recited in claim 11, wherein the opposing bores each having a kidney shaped configuration.

14. The automotive clamp accessory as recited in claim 11, further including side walls that extend the length of the base member.

15. The automotive clamp accessory as recited in claim 13, wherein sliding bars of the pull clamp are slidingly received within the opposing bores of the clamp accessory in order to position the pull clamp in a selected position.

16. The automotive clamp accessory as recited in claim 15, wherein said sliding bars of the pull clamp are tightened to the clamp accessory in the selected position with nuts.

17. The automotive clamp accessory as recited in claim 11, further including a reinforcement plate positioned on an upper surface of the first end portion, said reinforcement plate including a pair of apertures in alignment with the opposing bores.

18. An automotive clamp accessory comprising:

a base member comprising a first end portion, a second end portion, and a wall disposed between the first and second ends, a pair of opposing kidney-shaped bores through the first end portion, a body bore through the second end portion, means for fixedly attaching a prior art pull clamp to the first end portion, a reinforcement plate positioned on an upper surface of the first end portion, said reinforcement plate including a pair of apertures in alignment with the kidney-shaped bores, and wherein said wall creates a stair between said reinforcement plate and said second end portion such that an attachment point on said second end portion is aligned with a source of null and with said prior art pull clamp.

19. The automotive clamp accessory as recited in claim 18, further including a center hole disposed at an equal distance between the kidney-shaped bores, wherein said pull clamp can be selectively positioned at approximate 45 degree angle with respect to the center hole.

* * * * *